US005305906A

United States Patent [19]

Dietrich et al.

[11] Patent Number: 5,305,906

[45] Date of Patent: Apr. 26, 1994

[54] DRUM WITH PLUG

[75] Inventors: Klaus Dietrich, Fichtenberg-Mittelrot; Roland Winkler, Esslingen/Neckar, both of Fed. Rep. of Germany

[73] Assignee: Fraunhofer-Gesellschaft zur Forderung der angewandten Forschung e.v., Munich, Fed. Rep. of Germany

[21] Appl. No.: 955,235

[22] Filed: Oct. 1, 1992

Related U.S. Application Data

[63] Continuation of Ser. No. 502,169, Mar. 29, 1990, abandoned.

[30] Foreign Application Priority Data

Mar. 31, 1989 [DE] Fed. Rep. of Germany ..... 3910475

[51] Int. Cl.[5] ..... B65D 41/04

[52] U.S. Cl. ..... 220/288; 220/304; 220/601; 220/661

[58] Field of Search ..... 220/288, 601, 661, 304

[56] References Cited

U.S. PATENT DOCUMENTS

| | | | |
|---|---|---|---|
| 1,022,074 | 4/1912 | Graham | 220/601 X |
| 1,931,243 | 10/1933 | Wackman | 220/288 X |
| 1,992,793 | 2/1935 | Welter | 220/304 X |
| 2,156,237 | 4/1939 | Draper | 220/661 |
| 2,267,755 | 12/1941 | Schroeder | 220/304 X |
| 2,293,943 | 8/1942 | Merker et al. | 220/304 X |
| 2,387,990 | 10/1945 | Grosser | 220/601 X |
| 2,460,721 | 2/1949 | Thompson | 220/288 X |
| 2,675,142 | 4/1954 | Spayd | 220/304 |
| 3,647,110 | 3/1972 | Hammes | 220/601 |
| 4,114,779 | 9/1978 | Stoll, III | 220/288 |
| 4,117,949 | 10/1978 | Dwinell | 220/304 |
| 4,257,527 | 3/1981 | Snyder et al. | 220/675 |
| 4,316,318 | 2/1982 | Mineo | 220/304 X |
| 4,573,605 | 3/1986 | Udell | 220/304 |
| 5,016,775 | 3/1991 | Büdenbender | 220/288 |

FOREIGN PATENT DOCUMENTS

| | | |
|---|---|---|
| 2026922 | 12/1971 | Fed. Rep. of Germany . |
| 2428907 | 4/1976 | Fed. Rep. of Germany . |
| 2290362 | 11/1975 | France . |
| 505003 | 5/1971 | Switzerland . |

*Primary Examiner*—Stephen Garbe
*Assistant Examiner*—Stephen Cronin
*Attorney, Agent, or Firm*—Weingarten, Schurgin, Gagnebin & Hayes

[57] ABSTRACT

A container with a plug is described, with at least one plug hole, sealable in a liquid-tight manner by means of the plug. The container with plug is characterized by the plug hole surrounded by a collar made from the material of the container, the collar having at least one locking element to secure the plug, and having a sealing surface provided thereon, between which surface and the plug a sealing element for sealing the plug hole tightly is insertable.

1 Claim, 16 Drawing Sheets

DRUM WITH PLUG

This application is a continuation of application Ser. No. 07/502,169, filed Mar. 29, 1990. now abandoned.

The invention relates to a drum with a plug, made of a metallic material with at least one plug hole, which is sealable in a liquid-tight manner by means of a plug.

Containers with plugs made of metallic materials, and especially containers with plugs made of steel, are used to package liquid as well as solid pourable contents, and are described for example in DIN 6643, a German Industrial Standard, incorporated herein by reference.

By definition, a container with a plug has an opening which is smaller than the inside diameter of the container and which serves for filling, emptying, and venting the container. This opening is sealable as a rule by means of a safety cap. The container with the plug usually has a so-called Tri-Sure flange, and a corresponding sealing plug. For more information on the design of this flange and the matching plug, see DIN 6643, Part 2.

The Tri-Sure flange is manufactured as a separate part independently of the container itself. The flange is mounted on a container by a compression process, in which a gasket suitable for the type of contents is inserted between the wall of the container and the flange (cf. DIN 6643, Part 2, V1 Safety Cap). This known safety flange suffers from a number of disadvantages because of its design.

First, manufacture is expensive, since the flange is produced independently of the container. Second, because of the compression process, the pressure resistance of the flange is comparatively low.

SUMMARY OF THE INVENTION

The goal of the invention is to improve on a container with a plug having at least one plug hole, sealable in a fluid-tight manner by means of a plug, in such a way that the container is easy to manufacture and has high pressure resistance. The container with plug according to the invention also conforms to DIN 6643.

According to the invention, the plug hole is surrounded by a collar made from the metal material of the container, said collar having at least one locking element to secure the plug and having a sealing surface on it between which surface and the plug a sealing element for providing a tight seal of the plug hole can be inserted.

The design according to the invention makes it possible to dispense with the gasket provided in conventional Tri-Sure flanges between the wall of the container and the flange element itself even when the locking element is mounted on a ring which is permanently attached to the collar. Elimination of the gasket inserted between the container wall and the flange, said gasket being suitable for the contents, represents a considerable cost savings in manufacture. In particular, however, the design according to the invention makes it possible to design the locking element either in one piece with the collar (claim 2) or by using a considerably simpler manufacturing method than compression, welding for example (claim 9), to connect it to the collar.

The one-piece design offers another simplification of manufacture since it is no longer necessary to manufacture the flange and/or locking element in a separate manufacturing step. In this case it is especially preferable if the locking element according to claim 10 is mounted in the collar by means of a process not requiring chip removal, since the collar wall will then not be weakened.

Regardless of whether the locking element is made integral with the collar or as a separate part, for example, one which is connected with the collar by spot welds, the locking element can have, i.e., according to claim 5, an internal thread on the inside of the collar, i.e., according to claim 4, an outside thread on the outside of the collar, or i.e., according to claim 8, a bayonet engaging element, for which matching elements are provided on the plug.

It is preferable for manufacturing reasons if, according to claims 6 and 7, the thread and especially the internal thread extends only over a portion of the circumference of the collar and/or additional ring. In addition, depending on the application, it may be preferable for the locking elements to be designed so that "standard plugs" may be used. It is also preferable, for the seal provided according to the invention between the collar and the plug that the collar and the plug each have a (flat) contact surface (claim 11) between which the sealing element is insertable, which element according to claim 12, for example, can be an O-ring.

The collar can project outward or inward (claims 13 and 14) depending on whether the complete drainability of the container or protection of the plug against damage is more important. To protect the plug, a bead made from the same material as the container and having a height which is greater than that of the collar can also be provided. This bead can surround the collar (claim 15) or a support ring can be provided as well (claim 16). The container according to the invention can be further strengthened in the vicinity of the plug hole by bending the collar according to claim 17 in an "S"-shape both outward and inward.

The invention is described below without limitation of the general idea of the invention with reference to embodiments and with reference to the drawings as examples, in which all of the specifics not discussed in greater detail in the text are referred to expressly with regard to disclosure.

DETAILED DESCRIPTION OF THE INVENTION

Figure 1A:
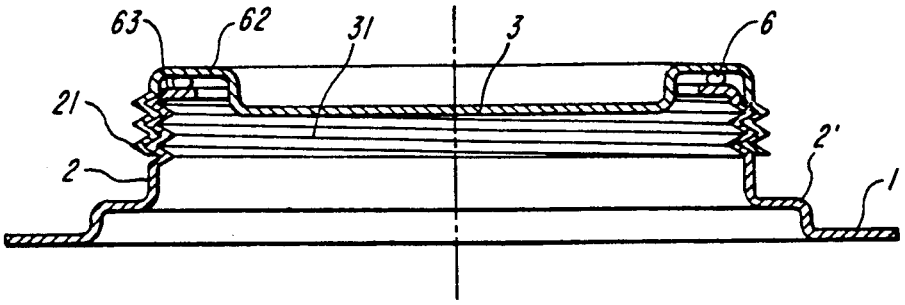
FIGS. 1*a* and 1*b* show various designs of a first embodiment of the invention.
Figure 1B:
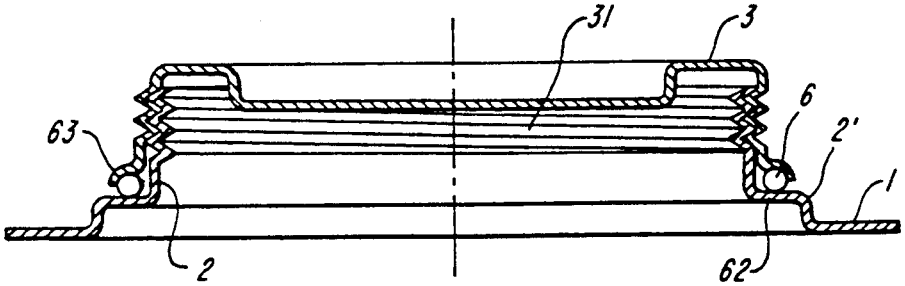

In all of the following figures, the same reference numbers have been used for the same elements throughout, so that in the explanations of the individual figures, the corresponding parts will not be listed again. The meanings are as follows:

1: container lid (shown only partially)
2: collar
21: locking element on collar 2
22: hole in collar 2 or in ring 4
3: plug
31: locking matching element on plug
32: tab
4: additional mounted ring
41: spot welds
5: connection between ring 4 and collar 2
6: sealing element
62: sealing surface on collar 2
63: sealing surface on plug 3
7: support ring FIGS. 1*a* and 1*b* show a first embodiment of the invention in which the collar is "formed" from the same metallic material, for example a steel alloy as container lid 1, and in which locking element 21 on collar 2 is an external thread provided therein, into which an internal thread 31 provided on plug 3 is screwed. In addition, collar 2 has a crimp-like elevation 2' which serves to reinforce the plug area as well as for improved draining of the container. The designs shown in FIGS. 1*a* and 1*b*) differ in the arrangement of sealing surfaces 62 and 63 provided on collar 2 and of sealing elements 6 made in the form of O-rings. In the design shown in FIG. 1*a*, O-ring 3 is located "inside" so that the screw connection remains "dry" while in the design shown in FIG. 1*b* O-ring 6 rests on crimp-type elevation 1'. Regardless of the different arrangement of sealing surfaces 62 and 63 as well as sealing element 6, the sealing function in the two designs is ensured regardless of the tightness of the threaded connection.

Figure 2A:
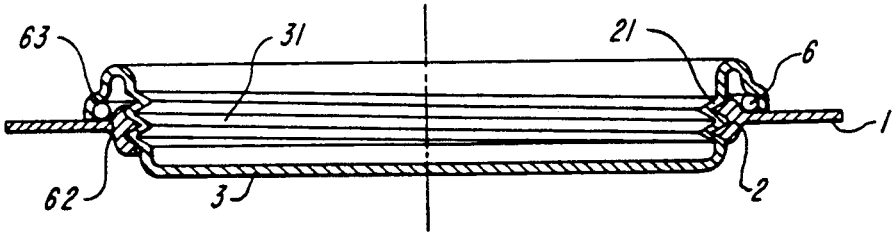
FIGS. 2*a* and 2*b* show various designs of a second embodiment of the invention.
Figure 2B:
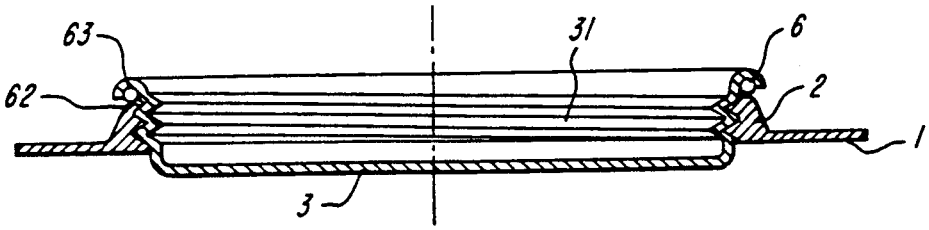
Figure 3A:
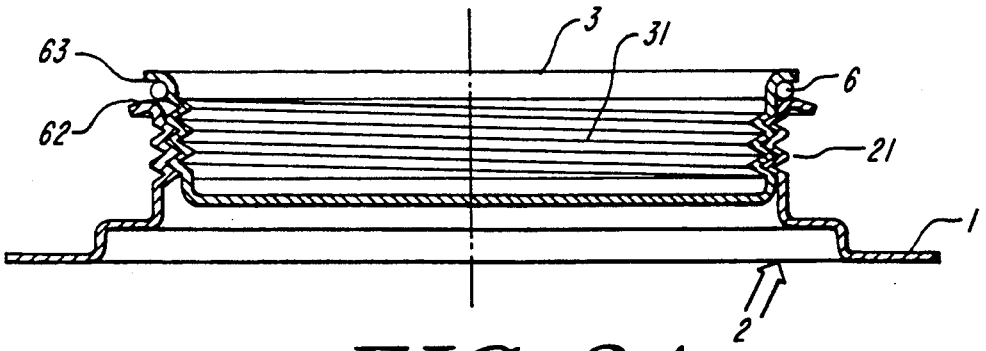
FIGS. 3*a* to 3*h* show various designs of a third embodiment of the invention.
Figure 3B:
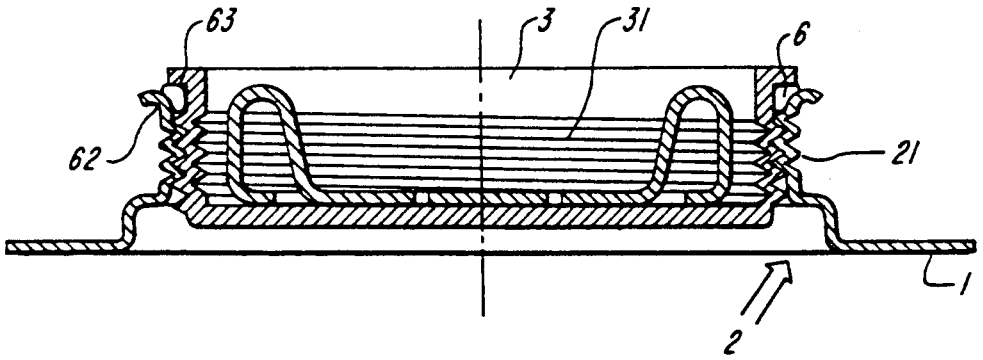
Figure 3C:
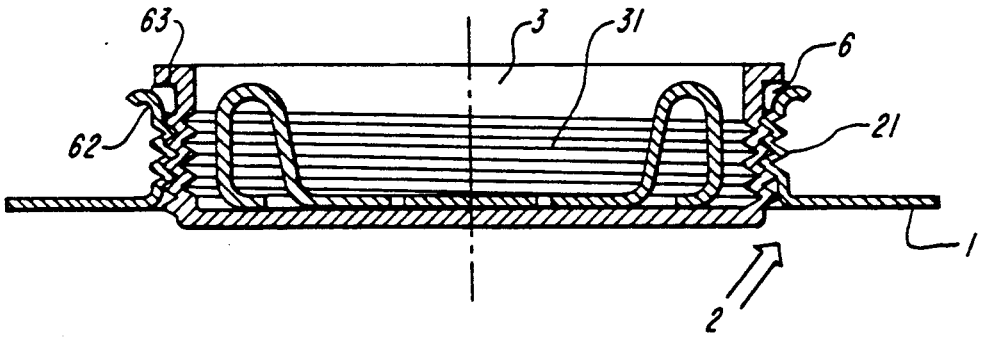
Figure 3D:
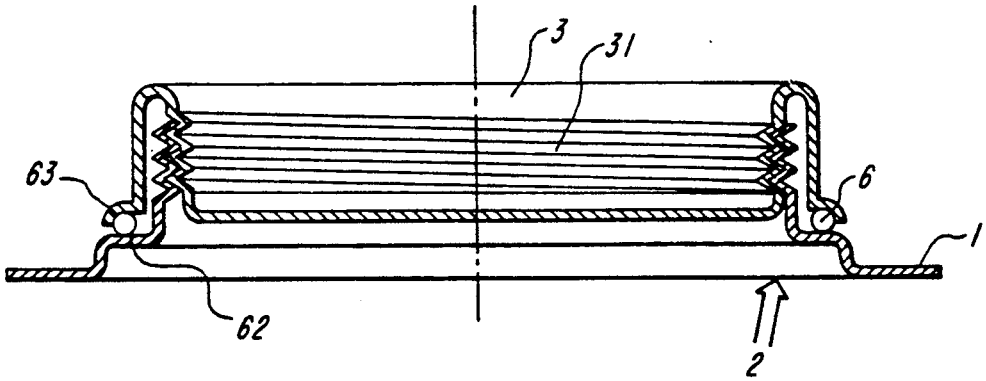
Figure 3E:
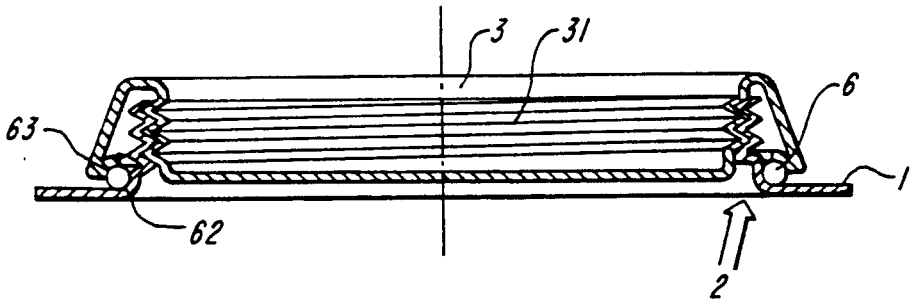
Figure 3F:
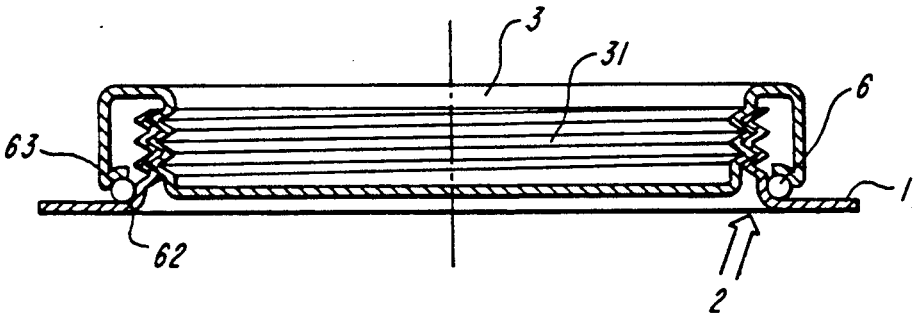
Figure 3G:
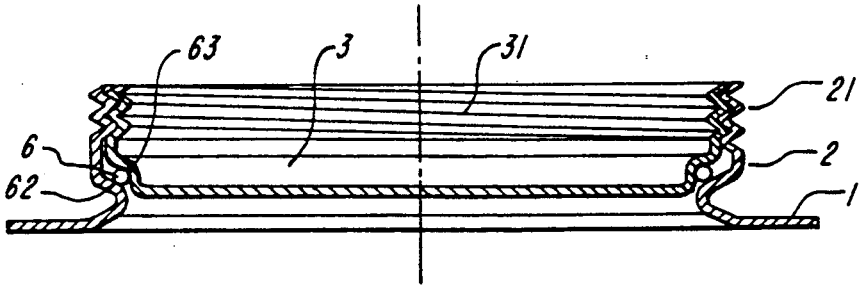
Figure 3H:
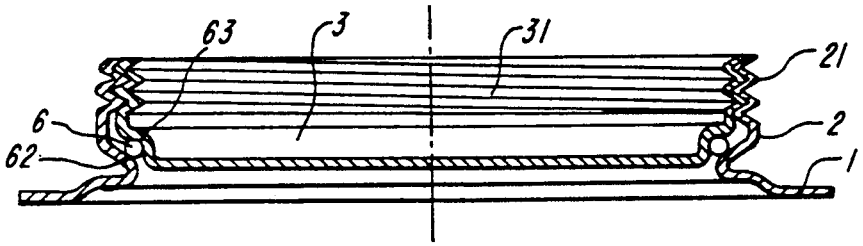

FIGS. 2*a* and 2*b* show a second embodiment of the invention in which collar 2, as a locking element, has an internal thread 21 and an external thread 31, corresponding to plug 3 as a matching element. Collar 2 is not formed from container lid 1, but is produced by pinching the material of container lid 1. The designs shown in FIGS. 2*a* and 2*b* differ in the arrangement of sealing element 6, once again in the form of an 0-ring, as well as sealing surfaces 62 and 63 on collar 2 and on plug 3. The reader is expressly referred to the drawing with respect to the exact design of the sealing surfaces. The design shown in FIG. 2*a* has the advantage that, when the shape and line thickness of O-rings 6 are suitable, the complementary convexity of collar 1 produces a comparatively large contact surface, while the design shown in FIG. 2*b* has the advantage that O-ring 6 is guided in a groove in plug 3.

FIGS. 3*a* to 3*h* show a third embodiment of the invention in which collar 2, as in the embodiment according to FIGS. 1*a* and 1*b*, is formed by crimping, deep-drawing, pressing, etc. from the material making up container lid 1. In contrast to the embodiment shown in FIGS. 1*a* and 1*b*, collar 2 however has an internal thread 21 as a locking element which engages a matching external thread 31 on plug 3. The designs shown in FIGS. 3*a* to 3*h* differ in the arrangement of the sealing element once again in the form of an O-ring 6 as well as the matching sealing surfaces 62 (on collar 2) and sealing surfaces 63 (on plug 3). The reader is expressly referred to the drawing with regard to the various possible designs. Once again the various designs differ from one another in the design of the collar, which has partially crimp-shaped reinforcements, while in other designs on the other hand it is made as simple as possible to simplify manufacture. The designs shown in FIGS. 3*b* and 3*c* have the advantage that standard plugs 3 with standard threads (2 inches and/or ¾ inch) can be used. In the designs shown in FIGS. 3*a* to 3*c*, which permit the use of standard plugs 3, the sealing element is located at the outermost end of the threaded connection. The designs shown in FIGS. 3*d* to 3*f* likewise have an external sealing element 6. However, sealing element 6 and sealing surfaces 61 and 62 are arranged so that the sealing function is ensured independently of the threaded connection. The individual designs differ from one another only in the shape of collar 2 and plug 3. In the designs shown in FIGS. 3*g* and 3*h*, the collar has a base, a neck, and a lip. An O-ring 6 is located "in front of" the threaded connection so that the latter remains "dry".

Figure 4A:
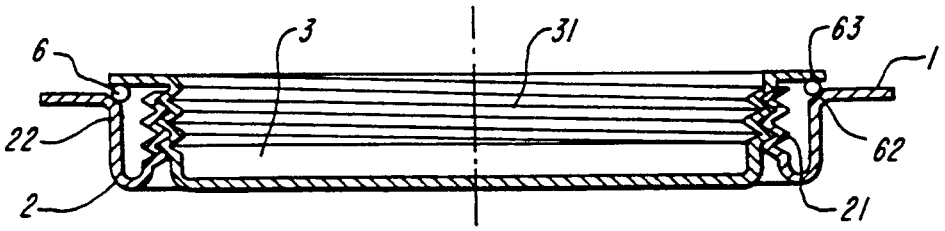
FIGS. 4*a* and 4*b* show various designs for a fourth embodiment of the invention.
Figure 4B:
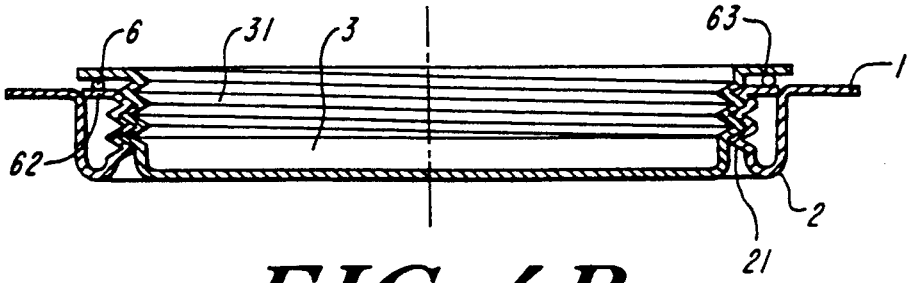

FIGS. 4*a* and 4*b* show a fourth embodiment of the invention in which collar 2 is provided not extending outward but inward in the form of a "U". Once again, the collar has as a locking element an internal thread 21 for which a matching external thread 31 is provided on plug 3. In addition, holes 22 are provided in collar 2, said holes ensuring complete drainability of the container. The design shown in FIG. 4*b* differs from the design in FIG. 4*a* in that a flat contact surface 62 is provided on collar 2.

In the embodiments described above, threads are used exclusively as locking elements 21 on the collar at 2 and as locking matching elements 31 on plug 3. Of course, it is also possible instead of threads to use different locking connections, for example a bayonet connection mechanism.

Figure 5A:
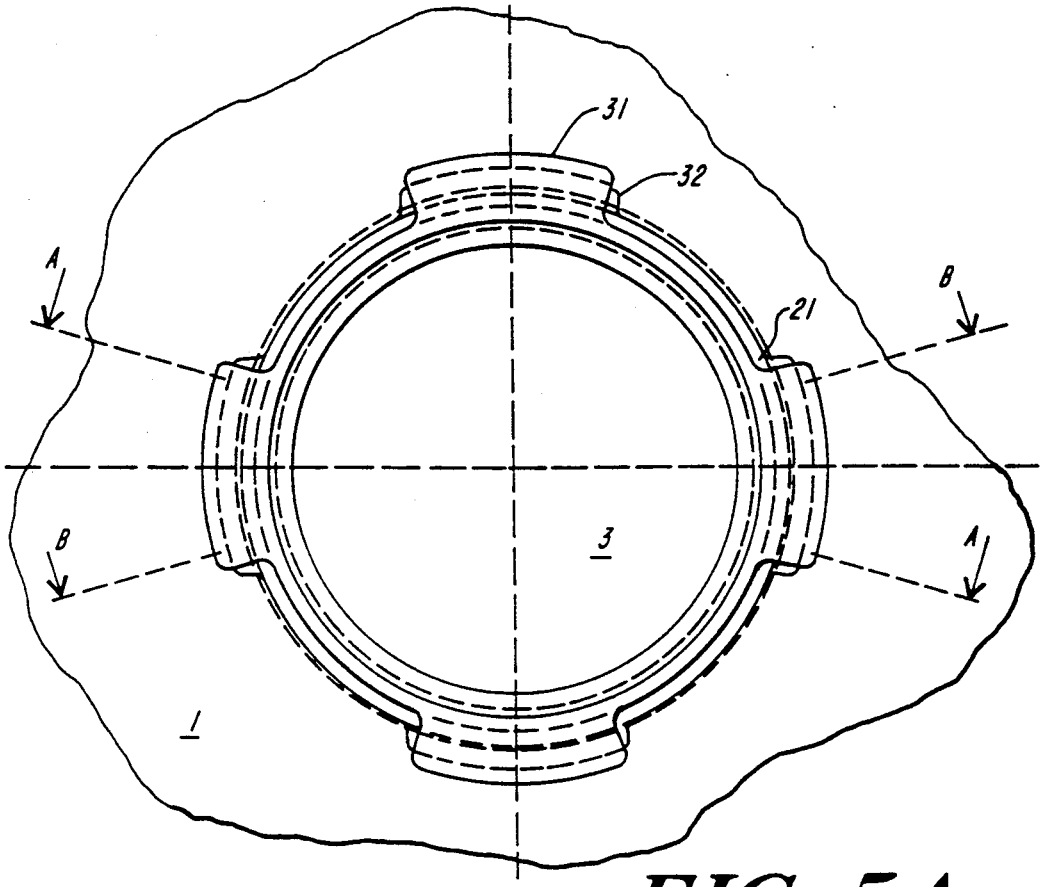
FIGS. 5 (*a* to *c*) show various embodiments with a bayonet plug.
Figure 5B:
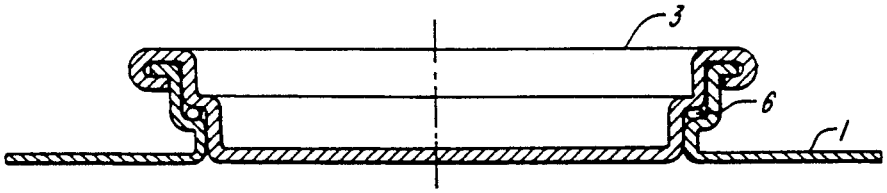
Figure 5C:
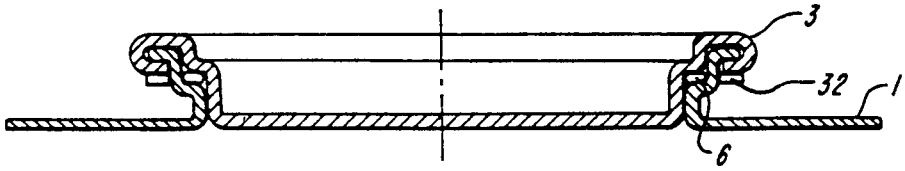

FIGS. 5 (*a* to *c*), 6 (*a* to *c*) and 7 (*a* to *c*) show three versions of a bayonet locking mechanism. In partial FIGS. 5*a* to 7*a*, we have a top view of the hole area and in partial FIGS. 5*b* to 7*b* and 5*c* to 7*c* cross sections at B-B and A-A in partial FIGS. 5*a* to 7*a*.

FIG. 5 (*a* to *c*) shows a design for a bayonet locking mechanism with an externally gripping connection for plug 3 with collar 2. Both collar 2 and plug 3 have suitable locking elements 21 and 31 respectively, shown in the drawing. The arrangement of the sealing element, again in the form of an O-ring 6, is selected so that it cannot be displaced by internal or external pressure. Tabs 32 are provided on plug 3 to prevent it from being turned too far.

Figure 6A:
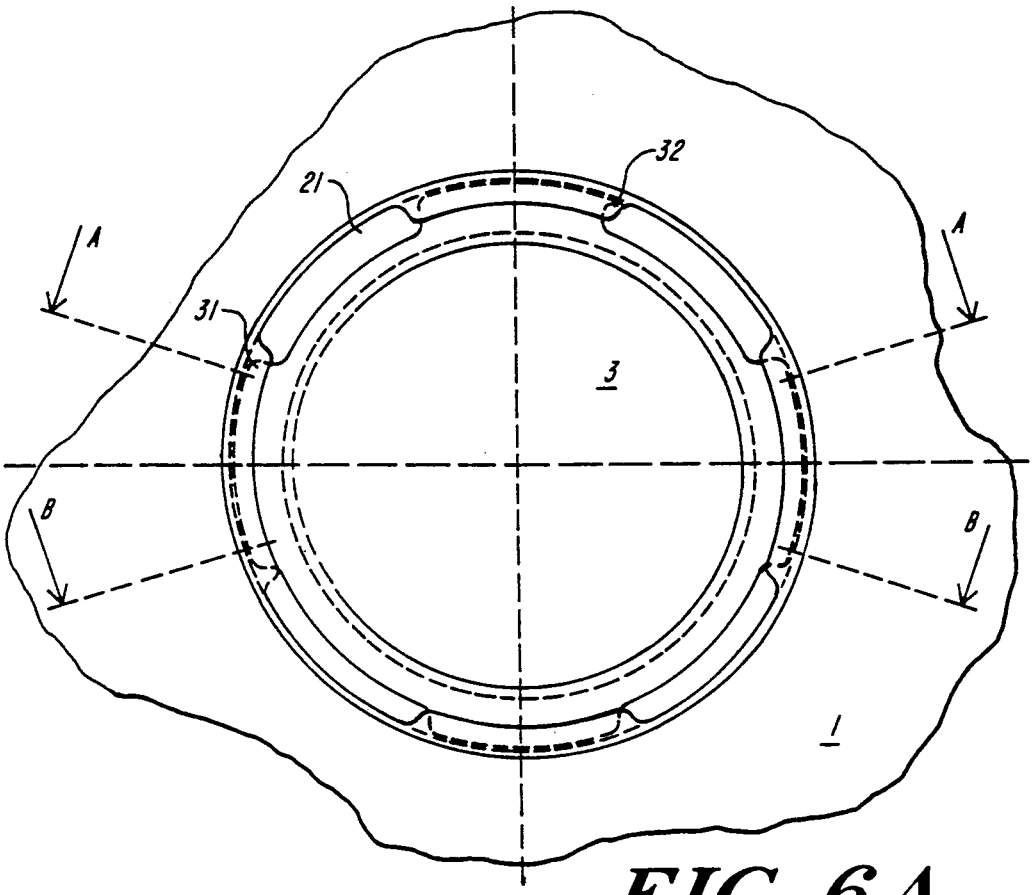
FIG. 6 (*a* to *c*) show various embodiments with a bayonet plug.
Figure 6B:
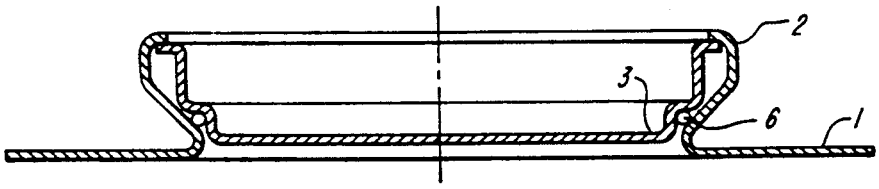
Figure 6C:
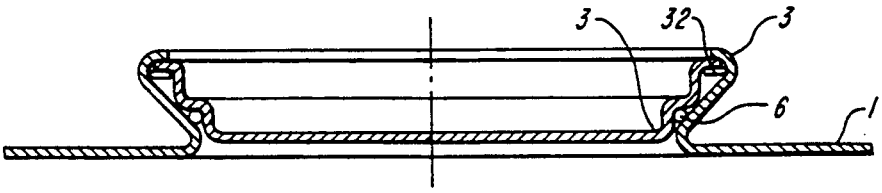
Figure 7A:
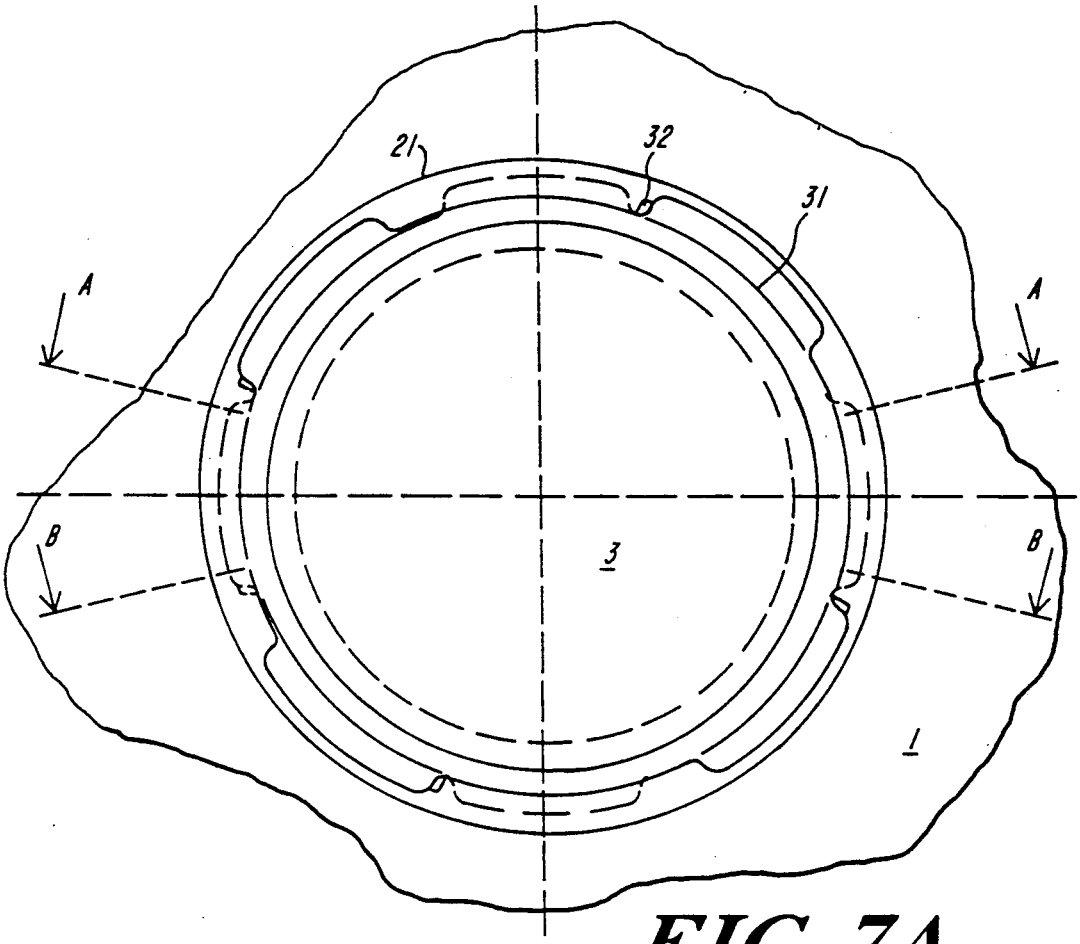
FIG. 7 (*a* to *c*) show various embodiments with a bayonet plug.
Figure 7B:
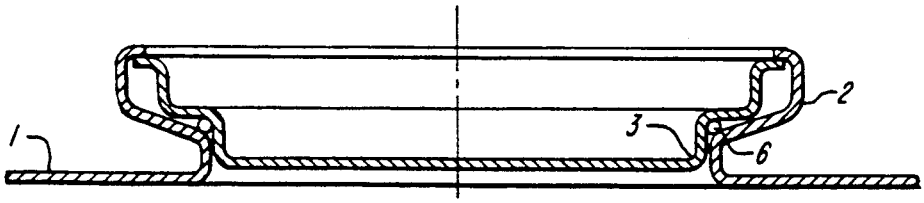
Figure 7C:
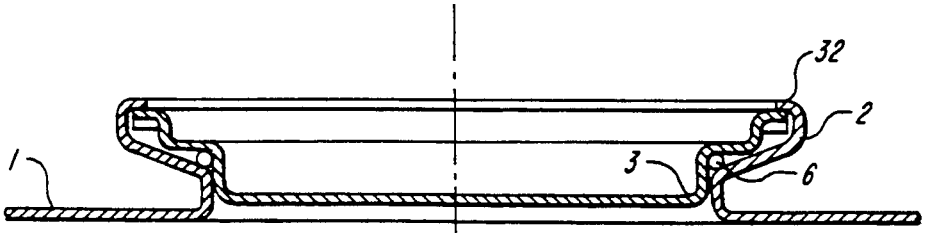

The embodiment shown in FIG. 6 (*a* to *c*) differs from the embodiment shown in FIG. 5 (*a* to *c*) in that the connection of plug 3 to collar 2 is internal. The position of sealing element 6 once again is made such that it cannot be displaced by the contents. In the same manner as in the fifth embodiment, tabs 32 are provided to protect against overtightening.

The embodiment shown in FIG. 7 (*a* to *c*) differs from the embodiment shown in FIG. 6 (*a* to *c*) and largely corresponds to the embodiment shown in FIG. 5 (*a* to *c*) but it has a different design, especially in the vicinity of the seal. In any case, the pitch of the bayonet connection can be selected so that the desired pretensioning of the seal is achieved. It is particularly important in connection with the container according to the invention that no additional material is required to manufacture the bayonet flange of the plug connection, since the flange can be formed completely from container lid 1.

All of the embodiments described above have in common the fact that the so-called hole flange, in other words the collar 2 including locking elements 21 on the collar, are molded completely from the material of which container lid 1 is composed.

The following embodiments are described in which although collar 2 is made from container lid 1, additional stiffening and/or additional elements are mounted on the collar and/or the container lid which support the locking elements.

Figure 8A:
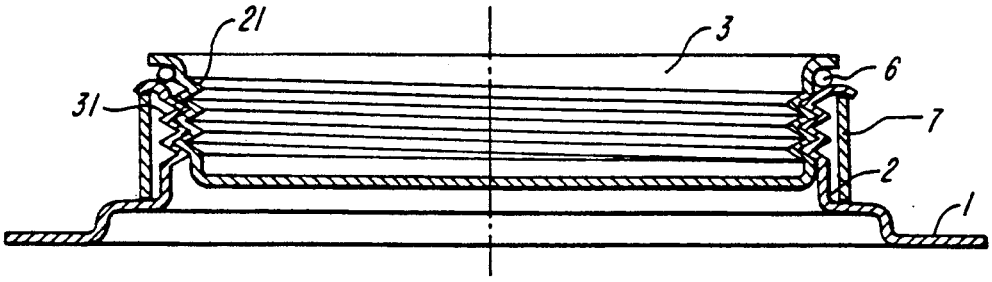
FIG. 8 (*a* to *c*) is an embodiment with a thread and a support ring.
Figure 8B:
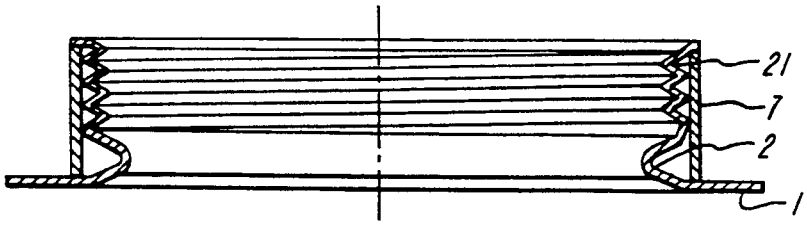
Figure 8C:
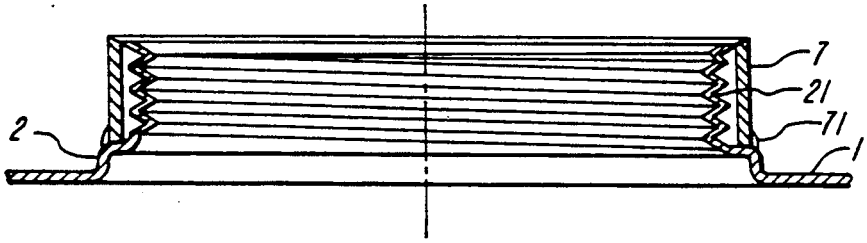

FIG. 8 (*a* to *c*) shows versions of an eighth embodiment in which a support ring 7 is mounted on container lid 1, said ring supporting collar 2 externally and thus increasing protection against bursting. In the designs shown in FIG. 8 (*a* and *b*), support ring 7 is "permanently crimped" on collar 2, while in the example shown in FIG. 8*c* on the other hand, permanent attachment by welding is provided by spot welds 71. Otherwise, the versions shown differ in the design of the collar and the position and design of sealing element 6 and the sealing surfaces. Reference is made here expressly to the drawings, wherein the support ring 7 has a lower edge attached to the base of the collar and an upper edge attached to the lip of the collar, as shown in FIGS. 8(*b*) and 8(*c*).

Figure 9A:
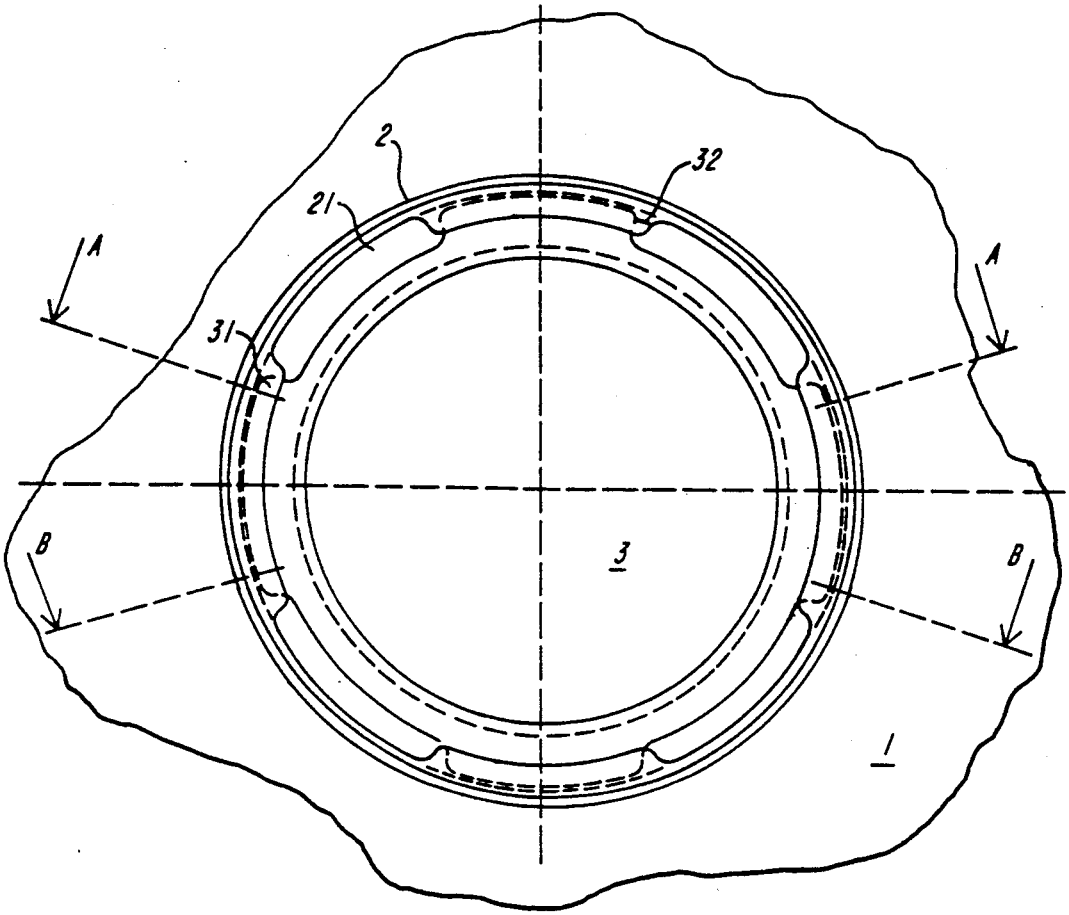
FIG. 9 (*a* to *c*) show an embodiment with a bayonet plug and a support ring.
Figure 9B:
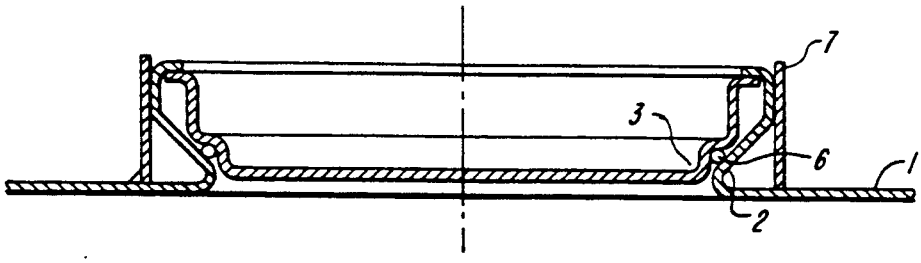
Figure 9C:
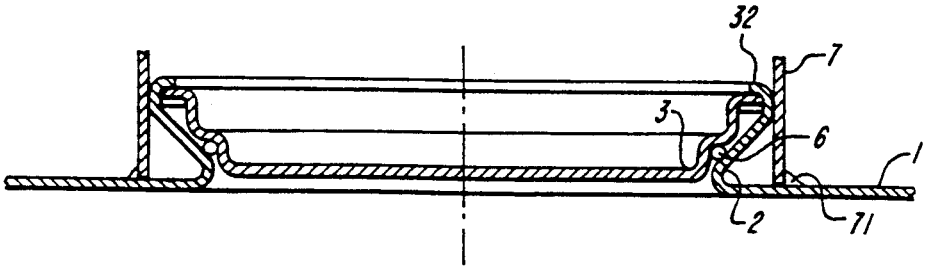

FIG. 9 (*a* to *c*) shows, in a representation similar to FIGS. 5*a* to 7*c*, an embodiment with a bayonet connection and additionally a support ring 7 welded on by spot welds or a welded seam 71, to increase protection against bursting. To avoid repetition, with respect to the other features in this embodiment, the reader is referred to the description for FIGS. 5 to 7.

Figure 10A:
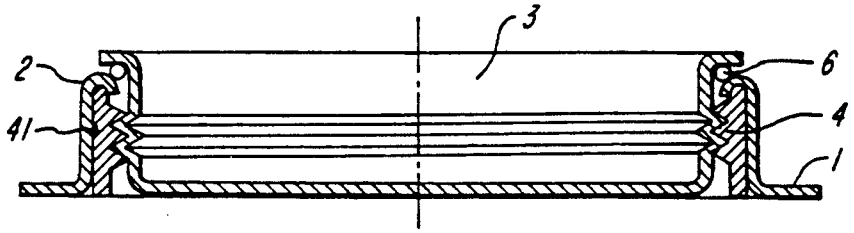
FIGS. 10*a* and 10*b*, 11*a* to 11*c*, and 12*a* to 12*f* show various embodiments with an additional threaded ring.
Figure 10B:
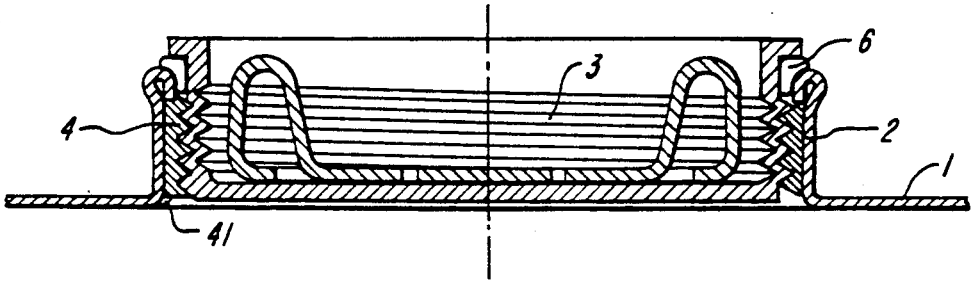

FIGS. 10*a* and 10*b* show designs for another embodiment of the invention in which a collar 2 is once again formed from the material of which container lid 1 is made, into which collar a ring 4 is inserted with an internal thread 21, said ring being held in position by spot welds 41 at the circumference. The position of the seal is chosen so that it is independent of inserted ring 4. In the design shown in FIG. 10*b*, the thread (e.g. ¾ inch or 2 inch) and the position of seal 6 are chosen so that commercial plugs 3 may be used and the sealing function is independent of internally threaded ring 4.

Figure 11A:
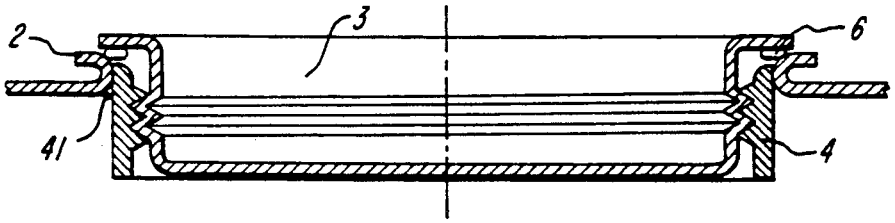
Figure 11B:
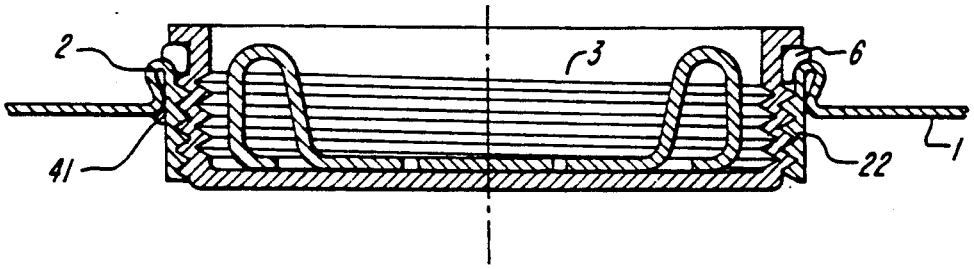
Figure 11C:
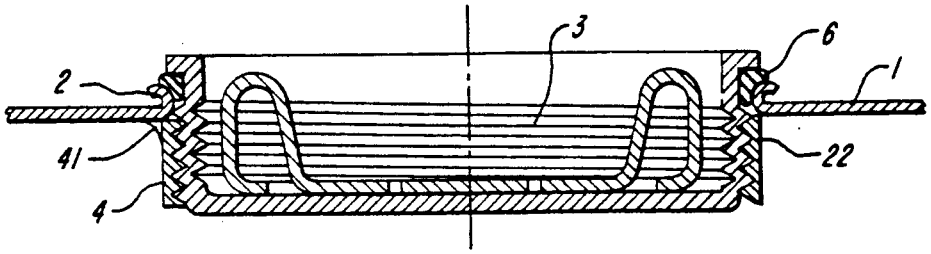

FIGS. 11*a* to 11*c* show designs for an embodiment with a "shortened" collar height. In the version shown in FIG. 11*a*, collar 2 is produced by simply crimping the material of container 1 outward, forming the sealing surface. An inwardly extending threaded ring 4 is fastened to the crimp by spot welds 41 on the circumference. The versions shown in FIGS. 11*b* and 11*c* differ from the version shown in FIG. 11*a* in the shape of the crimp and hence the arrangement of the sealing surface and/or sealing element 6. In addition, holes 22 are provided in welded ring 4 which permit complete emptying of the container. In addition, the internal thread on ring 4 is designed so that commercial plugs may be used.

Figure 12A:
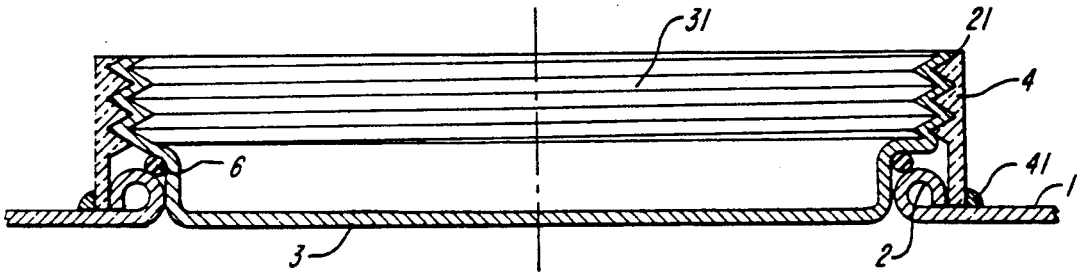
Figure 12B:
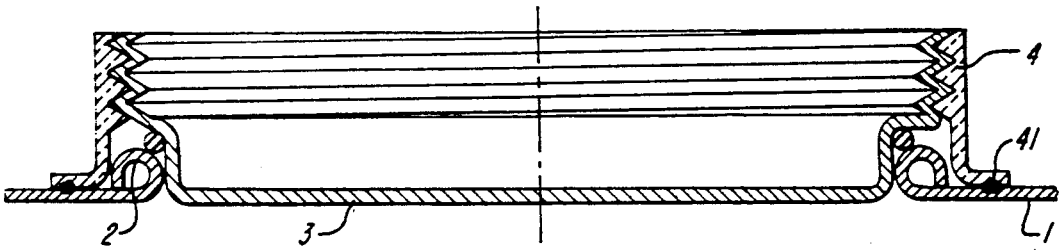
Figure 12C:
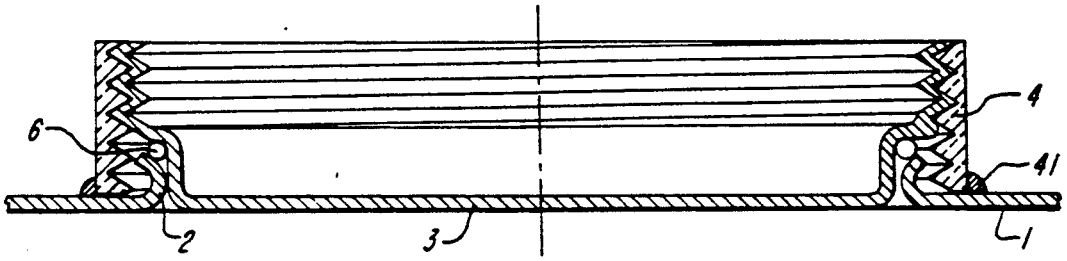
Figure 12D:
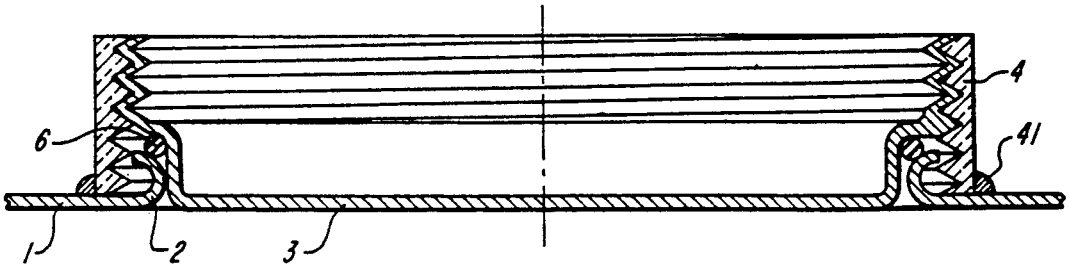
Figure 12E:
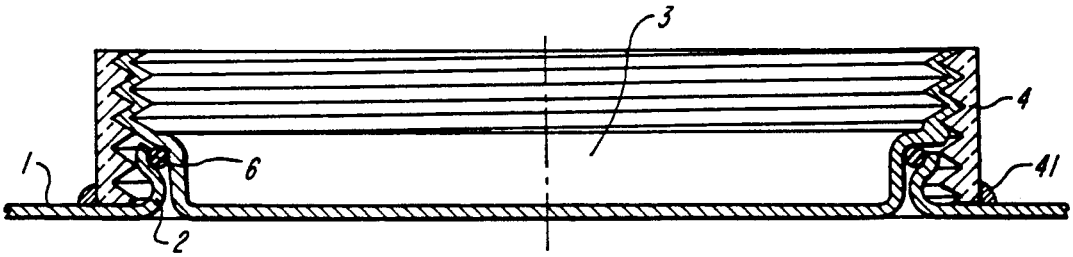
Figure 12F:
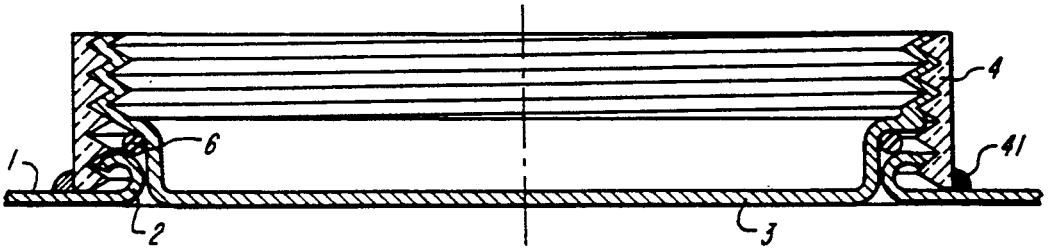

FIGS. 12*a* to 12*f* show sealing possibilities in which collar 2 is produced simply by crimping outward. An internally threaded ring 4 is mounted on container lid 1 and fastened by spot welds 41. Sealing is accomplished independently of the threaded connection between plug 3 and ring 4 by a seal 6 between plug 3 and collar 2 created by crimping. In the version shown in FIG. 12*a*, internally threaded ring 4 is hollowed out at one end to produce the largest possible inside diameter. The version shown in FIG. 12*b* is similarly designed, but additionally has a bead on ring 4 which allows the use of resistance welding for fastening. The version shown in FIG. 12*c* has no hollowed-out area on ring 4 so that it is simpler to manufacture. The versions shown in FIGS. 12*d* to 12*f* are similarly designed to the version shown in FIG. 12*c* and differ essentially only in the design of the bead and hence of seal 6.

The following discussion will refer to the embodiments in FIGS. 13 to 19, which in particular have improved protection against bursting.

Figure 13:
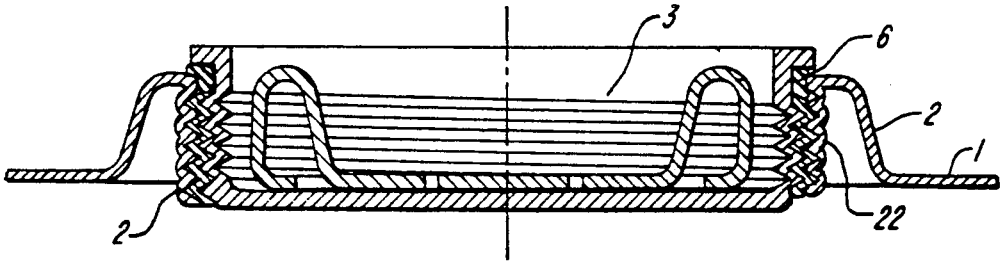
FIGS. 13 to 19 show additional embodiments.

FIG. 13 shows an embodiment in which collar 2 is produced by deep drawing of an annular protuberance from the non-perforated container material 1 with a subsequent perforation and additional deep drawing. A 2 inch or ¾ inch thread for example is pressed into the double wall thus produced. The design of the thread and the position of the sealing surface are selected so that ordinary plugs 3 may be used. Reference number 22 again refers to corresponding holes in "double" collar 2 which permit complete emptying of the container.

Figure 14:
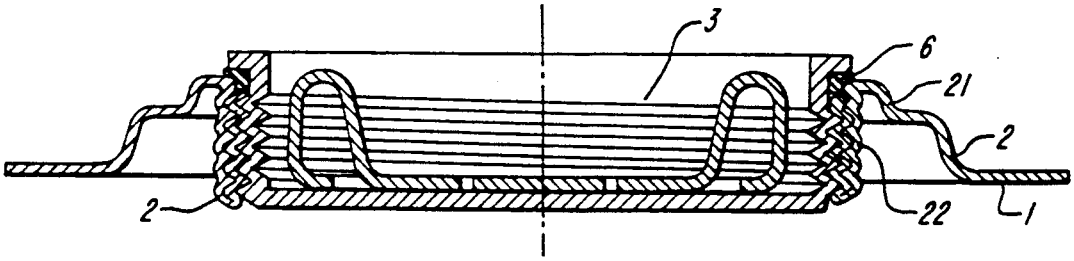

FIG. 14 shows an embodiment similar to the embodiment shown in FIG. 13, in which improved protection against bursting is achieved by an additional annular projection 2' in the form of a crimp or the like.

Figure 15:
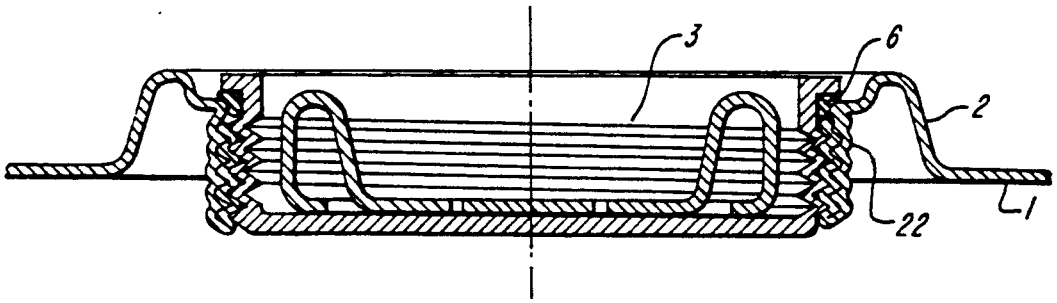

FIG. 15 shows an embodiment in which projection 2 which forms the collar is made so that it shields plug 3 if the container falls down. Otherwise this embodiment is largely similar to the embodiments shown in FIGS. 14 and 15.

Figure 16:
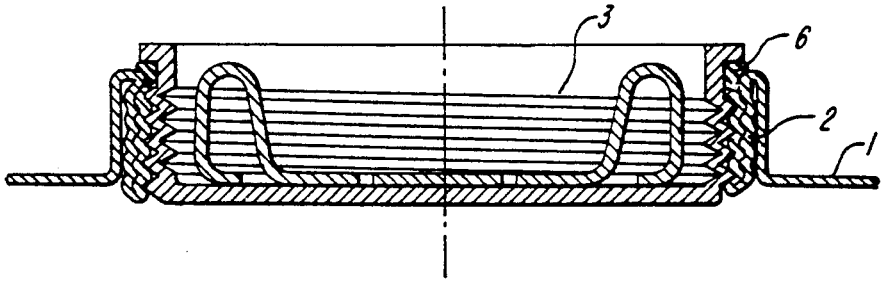
Figure 17:
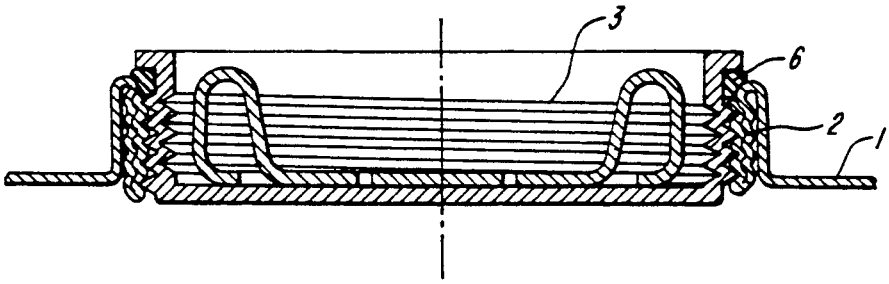

FIGS. 16 and 17 also show embodiments that resemble the embodiment in FIG. 13, in which, by an additional forming process, the annular projection is forced outward until the three walls are located side by side with no gaps between them. Then the thread can be stamped in. The differences between FIGS. 16 and 17 lie in the sequence of the individual wall parts.

Figure 18:
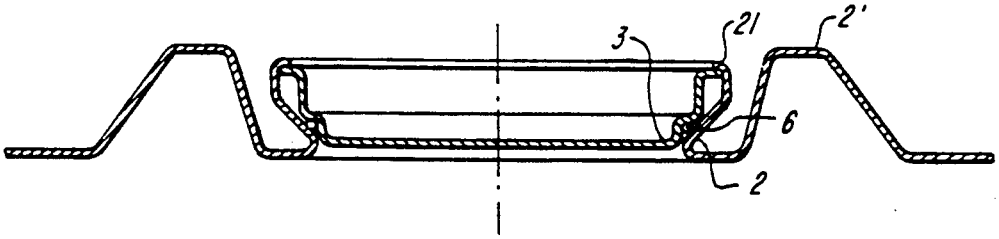
Figure 19:
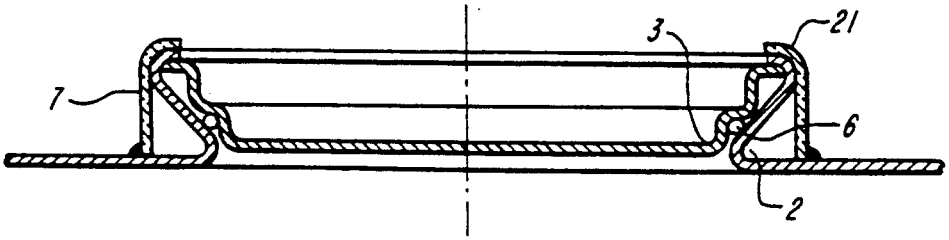
Figure 20A:
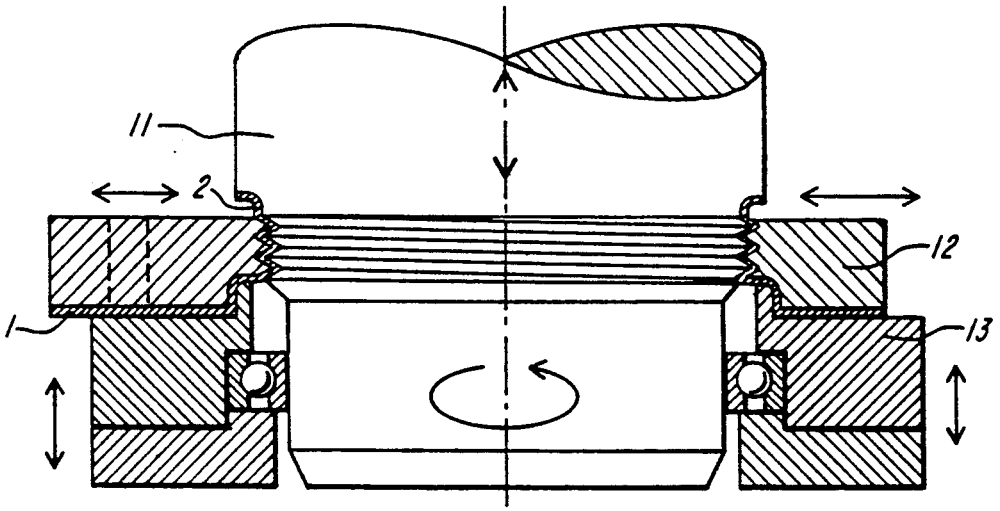
FIG. 20 (*a* to *d*) show views to illustrate manufacture.
Figure 20B:
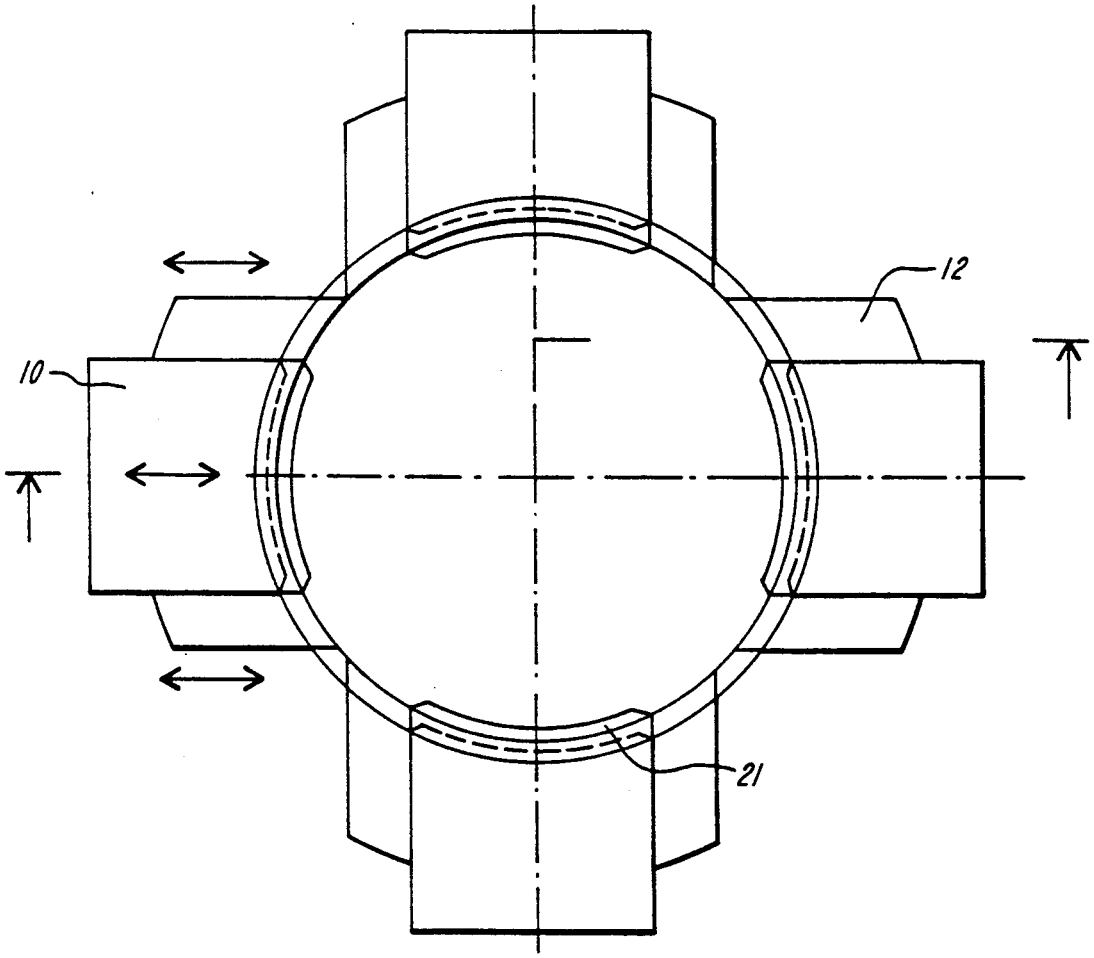
Figure 20C:
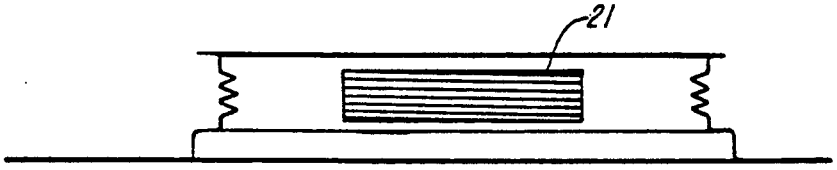
Figure 20D:
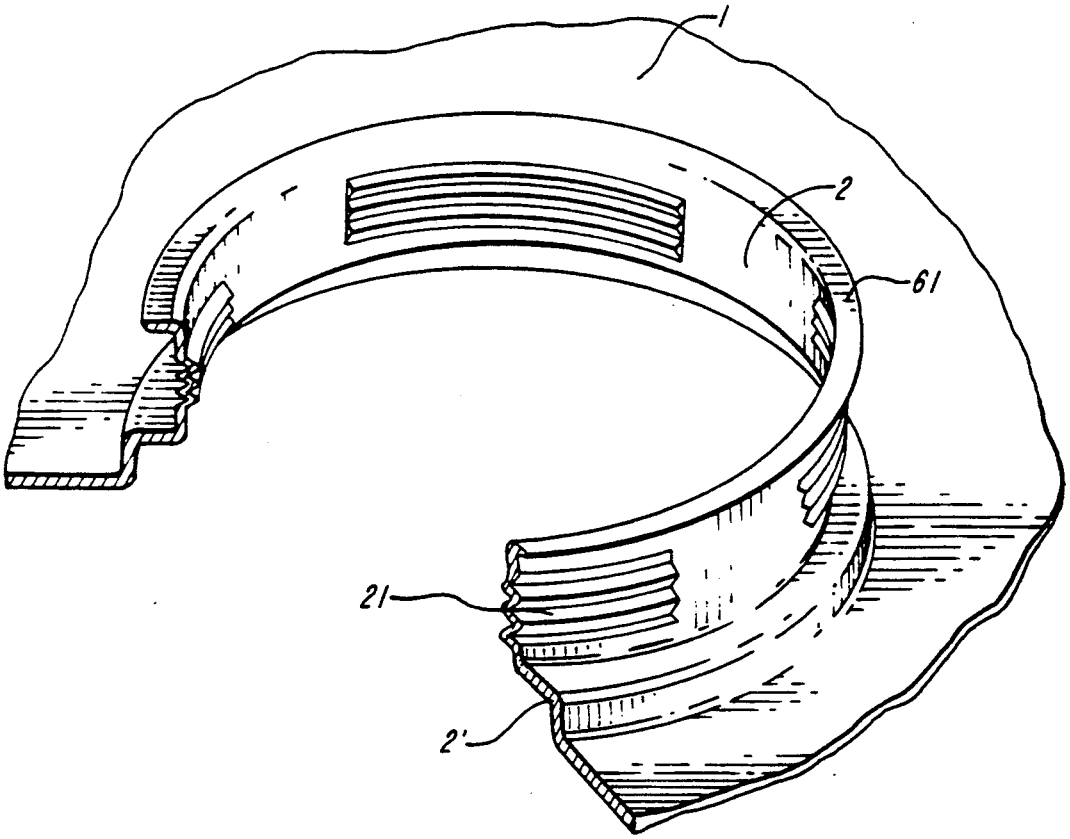

FIGS. 18 and 19 show embodiments in which bayonet connections are additionally protected, in one case by a corresponding bead 2' projecting beyond plug 3 and in the other case by an additional welded support ring 7.

Following is a description of the invention with reference to FIG. 20 (*a* to *d*), which shows a flange in a side view, a top view, another side view, and in perspective, the manufacture of a container with a plug.

Threaded segments 21 are used to fasten plug 3. These threaded segments are produced by thread-shaped punches 10 which press collar wall 2 against a corresponding threaded mandrel 11. While punch 10 forces parts of the collar wall into the threaded mandrel, the remaining areas of the flange are positively held by appropriately designed radial holddowns 12. With the aid of an axial holddown 13, lid 1 and collar 2 are positioned and held during the production of the threads; then the threaded mandrel is withdrawn. Thus, by providing recesses between the threaded segments, a provision is made such that the now-segmented threaded mandrel can be withdrawn axially by rotating it by a corresponding number of degrees.

Another improvement in manufacturing is achieved by providing axially movable slides in the recesses between the threaded segments. This has the advantage that when the thread is compressed by the thread punches into the segmented threaded mandrel, the walls of collar 2 which are not machined can be supported by the slides, and then the threaded mandrel as described above can be pulled out of the flange. Sealing surface 61 is supported during manufacture by suitable supports so that it keeps its shape within admissible tolerances. To increase the protection of the flange against bursting and bending, integrated and/or additional shaping steps can be provided during manufacture by which for example additional stiffening beads can be produced.

Although the invention has been shown and described with respect to illustrative embodiments thereof, it should be understood by those skilled in the art that various changes, omissions and additions in the form and detail thereof may be made therein without departing from the spirit and scope of the invention.

What is claimed is:

1. A metal container comprising:

at least one wall defining an interior and an exterior of said metal container, said wall having an opening providing access between the interior and the exterior;

a collar integrally formed from said wall and surrounding said opening, said collar and said wall being a unitary piece of metal bent both inward and outward in an "S"-shape, said collar including:

a base having an inwardly projecting portion including and an exterior facing O-ring seat;

a neck having a first locking element including a plurality of threads formed in said unitary piece of metal; and a lip;

a plug sized to fit within said opening, said plug having:

an upper plug portion having a second locking element including a second plurality of threads cooperative with said plurality of threads of said first locking element to retain said plug within said opening;

an interior facing O-ring seat alignable with said exterior facing O-ring seat of said inwardly projecting portion of said base; and an inner plug wall exposed to the interior of said container, said inner plug wall separated from said upper plug portion by said interior facing O-ring seat;

an O-ring disposed between said plug and said collar on said exterior facing seat, said O-ring having a larger diameter than an inwardmost portion of said exterior facing O-ring seat, said O-ring compressible between said interior and exterior facing O-ring seats to isolate said first and second locking elements from the interior of said container, and said O-ring holding said inner plug wall in spaced apart relation with said collar; and a support ring having a lower edge attached to said base and an upper edge attached to said lip for strengthening and protecting said neck.

* * * * *